US005491848A

United States Patent [19]

Wang

[11] Patent Number: 5,491,848

[45] Date of Patent: Feb. 20, 1996

[54] TWO-STAGE FLUSH DEVICE FOR A TOILET TANK

[76] Inventor: Kuo-Hsin Wang, No.140-77, Chu Lu Chien, Pao An Tsun, Jen Te Hsiang, Tainan Hsuan, Taiwan

[21] Appl. No.: 321,355

[22] Filed: Oct. 11, 1994

[51] Int. Cl.[6] ..... E03D 1/14; E03D 5/092

[52] U.S. Cl. ..... 4/405; 4/324; 4/410; 4/415; 251/229

[58] Field of Search ..... 4/324, 325, 326, 4/327, 405, 410, 413, 414, 415; 251/229, 231

[56] References Cited

U.S. PATENT DOCUMENTS

| | | | |
|---|---|---|---|
| 3,108,286 | 10/1963 | Moore | 4/324 |
| 3,546,715 | 12/1970 | Waistner | 4/325 |
| 4,038,707 | 8/1977 | Cass | 4/324 |
| 4,067,074 | 1/1978 | Harrison | 4/324 |
| 4,433,445 | 2/1984 | Morris et al. | 4/325 |
| 4,733,416 | 3/1988 | Ott | 4/410 |
| 4,750,221 | 6/1988 | Antunez, Jr. et al. | 4/410 |

*Primary Examiner*—Henry J. Recla
*Assistant Examiner*—Charles R. Eloshway
*Attorney, Agent, or Firm*—Pro-Techtor International

[57] ABSTRACT

A two-stage flush device for a toilet tank, comprising a cylindrical bolt having a center hole and fixed in a hole of a side wall of a toilet tank and partly exposing out of the side wall, a rotatable button having a shaft portion fitting in the center hole of the cylindrical bolt and also firmly connected with a first actauting arm connected with a low-level valve by way of chain, a rod connected to a button at an outer side and extending through the center hole of the rotatable button to operate a second actuating arm connected with a high-level valve by way of a chain, the first actuating arm lifted by the rotatable button for flushing a larger volume of water, and the rod operating the actuating arm for flushing a smaller volume of water.

3 Claims, 8 Drawing Sheets

TWO-STAGE FLUSH DEVICE FOR A TOILET TANK

BACKGROUND OF THE INVENTION

This invention concerns a two-stage flush device for a toilet tank, particularly one having a structure of flushing a larger volume of water by rotating a rotatable button and flushing smaller volume of water by pushing inward a push rod.

At present, a known conventional two-stage flush device for a toilet tank has a single exit tube closed by a valve, a double press rod provided with a press button A and a press rod B, by which water volume flushed through an exit hole closed by the valve is controlled as shown in FIG. 1. And FIG. 2 shows that a double press button with two buttons E, F is provided for manually pressing only the button E or the two buttons E, F at the same time for flushing two different volume of water.

However, the known conventional two-stage flush device for a toilet tank can flush two different volumes of water by means of a single exit tube, but the double buttons for flushing have a same direction of movement, easily and wrongly pressed to flush the larger volume of water by accident to lose the water saving function they are designed for.

There is another known conventional two-stage flush device for a toilet tank as shown in FIG. 3, having two exit holes H. I respectively closed and opened by separate valves controlled by two press buttons J, K. This kind of structure also has the same drawback seen in those shown in FIGS. 1 and 2, in addition to possible incorrect operation of the opening of the two valves.

Another known conventional two-stage flush device for a toilet tank as shown in FIG. 4 has two separate buttons L, M for correctly flushing different volumes of water, but needs two separate holes N, O for installing the two separate buttons L, M, and consequently making it impossible to be adapted in the present toilet tanks in market or in use. So it demands a new toilet tank or an old one to be transformed a little, to a resultant extra cost in installing.

SUMMARY OF THE INVENTION

The object of this invention is to offer a two-stage flush device for a toilet tank, which comprises two buttons having different moving directions for flushing two different volumes of water into the toilet bowl.

A two-stage flush device in the present invention is constructed to have the following features.

1. Flushing means include a rotatable button for flushing a larger volume of water through a valve closing a low-level exit tube, and a push rod being pushed inward for flushing a smaller volume of water through a valve closing a high-level tube.

2. The push rod for flushing a smaller volume of water through the high-level tube can be substituted with a pulling rod for pulling outward to flush water.

3. The two flushing methods are installed in common components, not separately installed, but cannot be operated wrongly by accident by dint of different direction of operating movement.

DETAILED DESCRIPTION OF THE INVENTION

Figure 1:
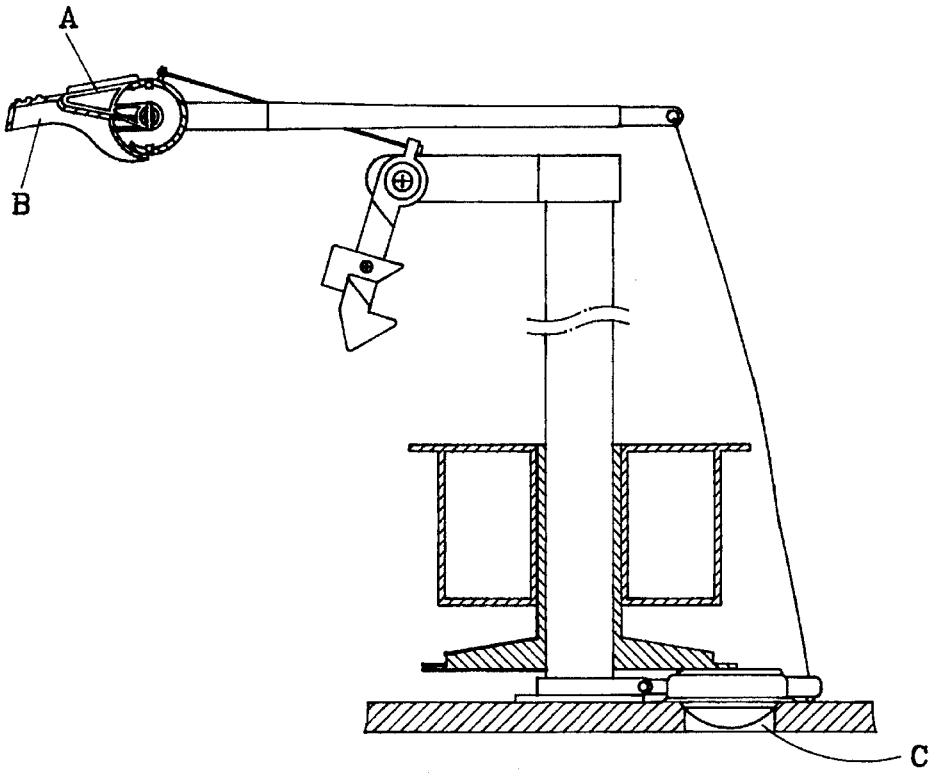
Fig 1 (PRIOR ART)
FIG. 1 is a first known conventional flush device for a toilet bowl.
Figure 2:
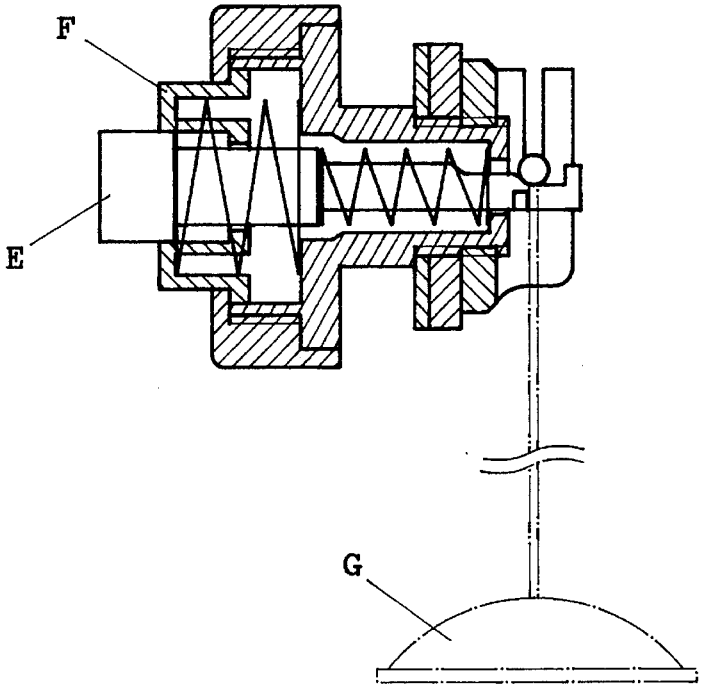
Fig 2 (PRIOR ART)
FIG. 2 is a second known conventional flush device for a toilet bowl.
Figure 3:
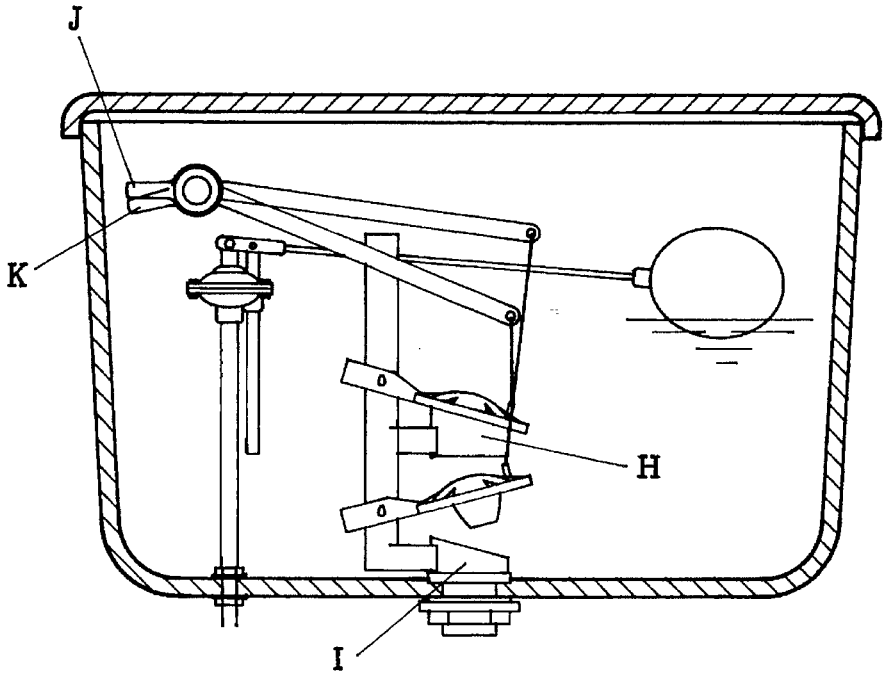
Fig 3 (PRIOR ART)
FIG. 3 is a third known conventional flush device for a toilet bowl.
Figure 4:
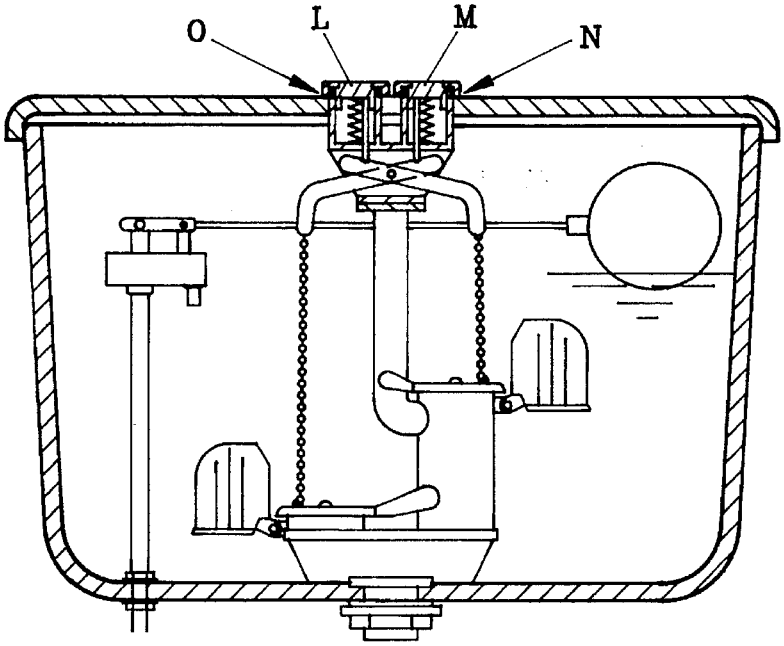
Fig 4 (PRIOR ART)
FIG. 4 is a fourth known conventional flush device for a toilet bowl.
Figure 5:
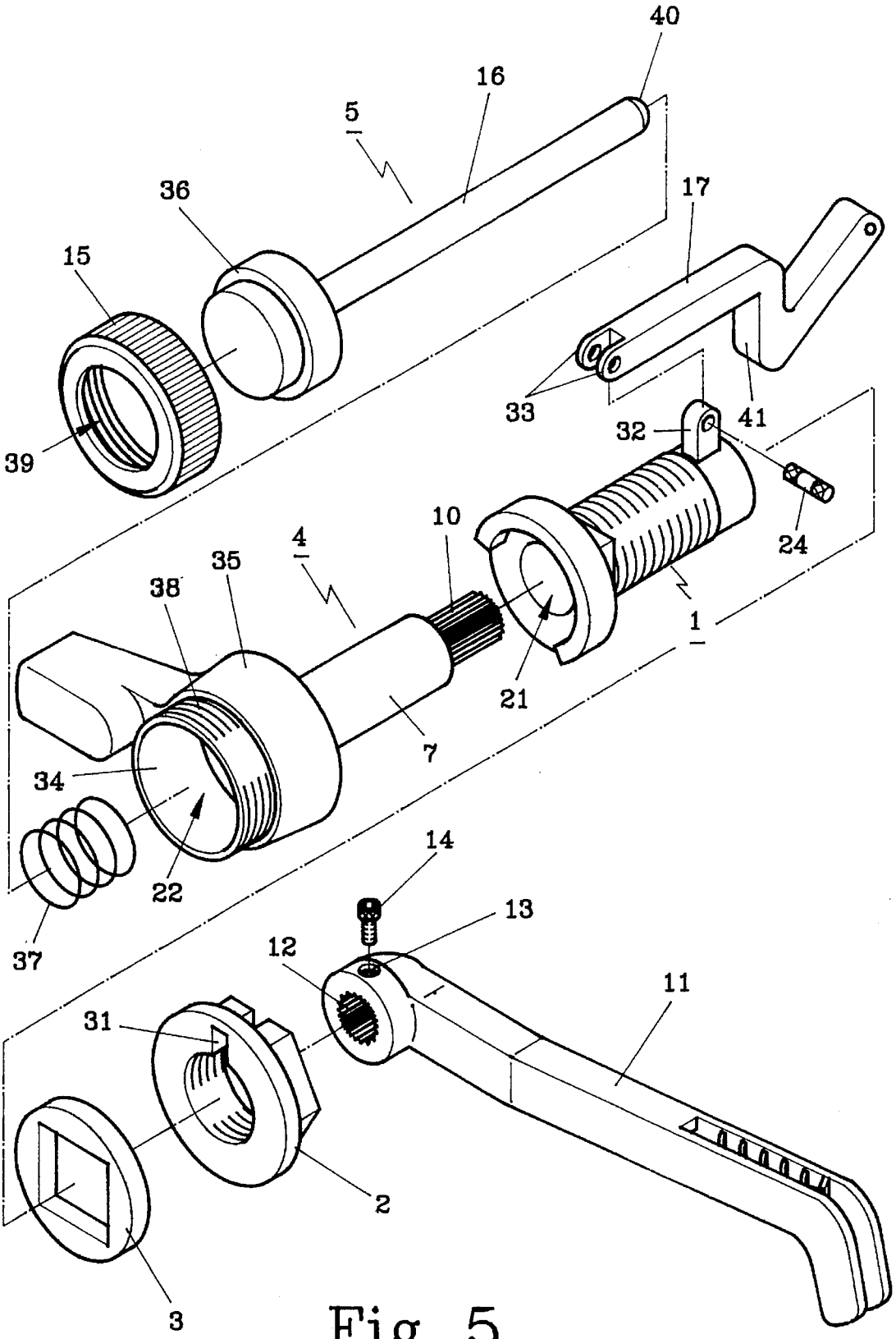
FIG. 5 is an exploded perspective view of a first embodiment of a two-stage flush device for a toilet tank in the present invention.
Figure 6:
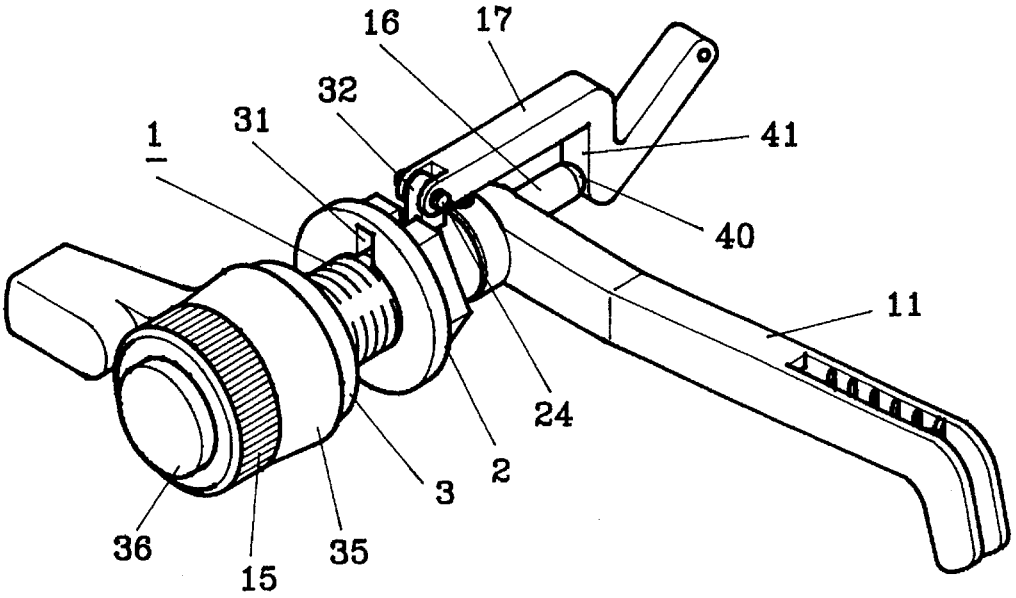
FIG. 6 is a perspective view of the first embodiment of the two-stage flush device for a toilet tank in the present invention.

A first embodiment of a two-stage flush device for a toilet tank in the present invention, as shown in FIGS. 5–8, comprises a cylindrical bolt 1 having a central through hole 21 for inserting a connecting shaft portion 7 of a rotatable button 4, and fixed firmly in a hole of a side wall of a toilet tank by means of a nut 2 and a washer 3 and partly exposing outside the side wall. The nut 2 has a slot 31 for a projecting 32 provided upright at one end of the cylindrical bolt 1 to pass through so that the nut 2 may engage threadably the outer surface of the bolt 1. The projection 32 has a sidewise hole and is fitted between a pair of parallel ears 33 at the inner end of a second actuating arm 17. The pair of ears 33 have respectively a sidewise hole to align with a sidewise hole of the projection 32 for a shaft 24 to fit therein to keep the second actuating arm 17 at its position. The outer end of the second actuating arm 17 is connected with an upper end of a chain 30 of a high level exit tube 28.

Figure 7:
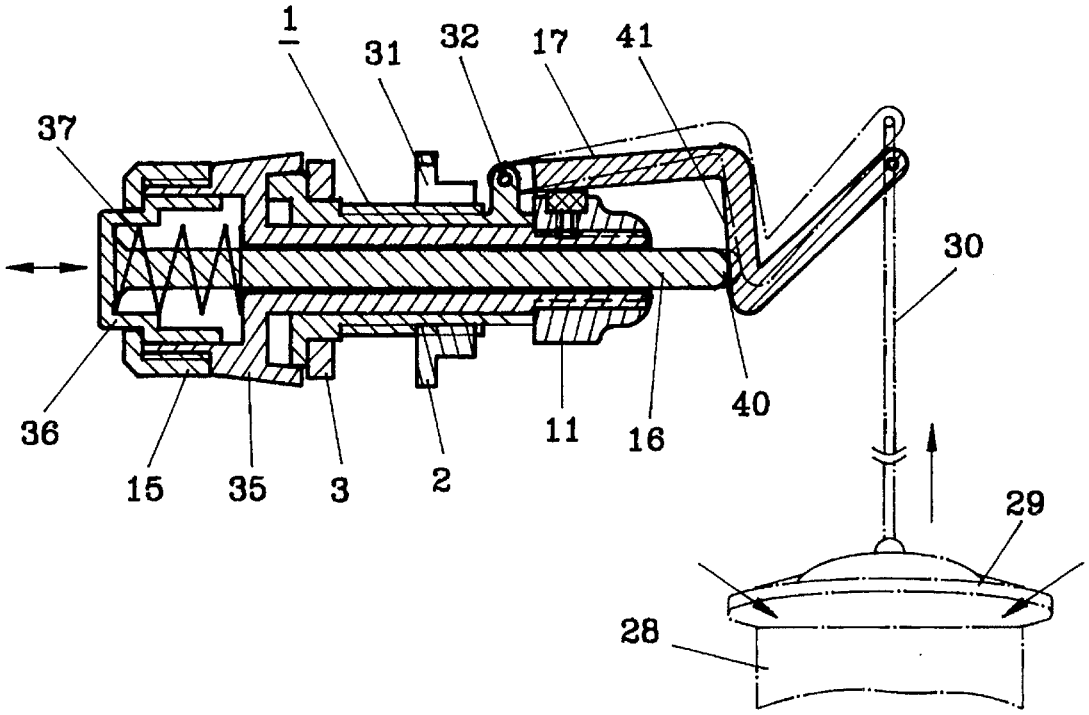
FIG. 7 is a cross-sectional view of the first embodiment of the two-stage flush device for a toilet tank in the present invention.
Figure 8:
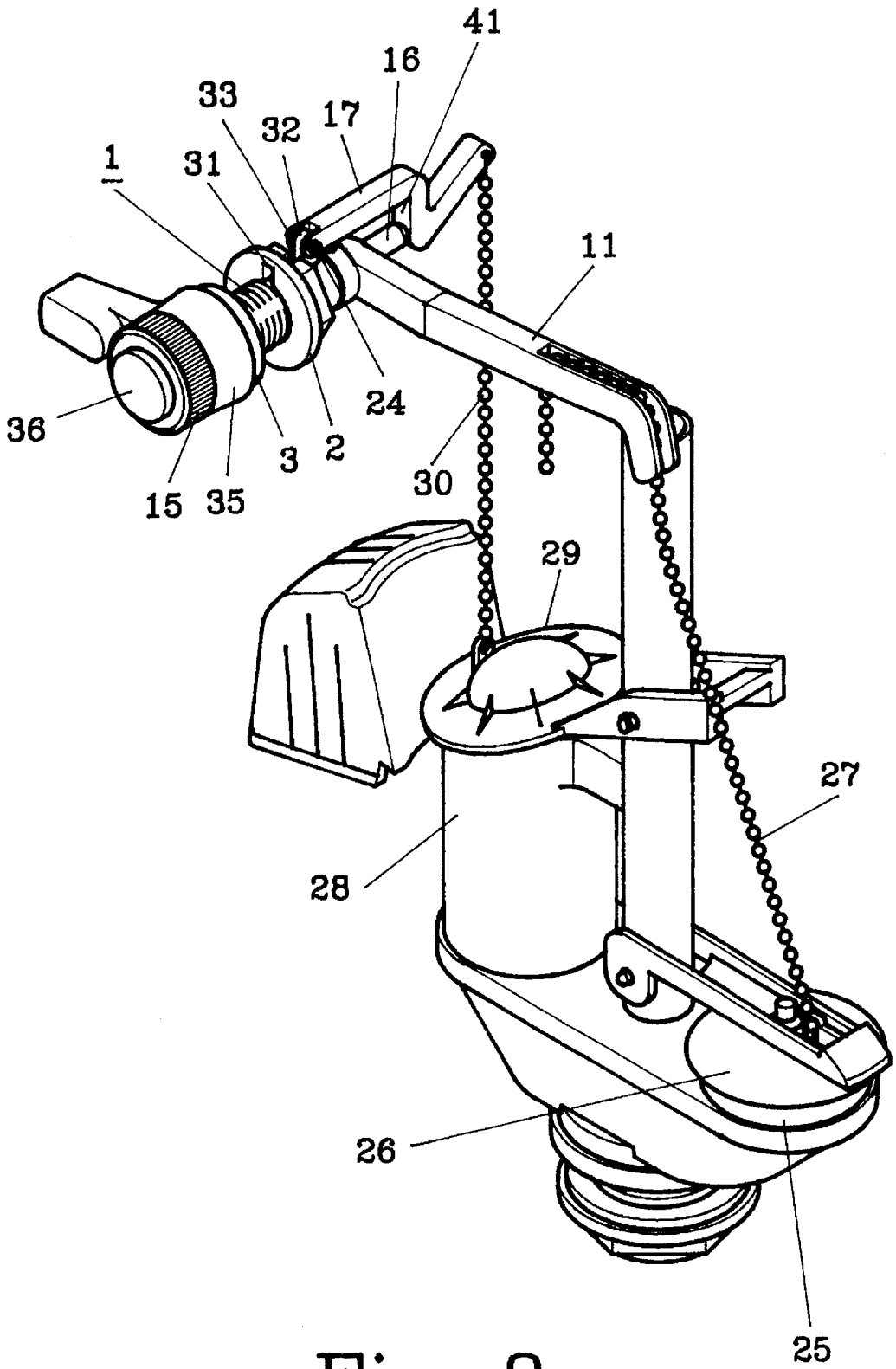
FIG. 8 is a perspective view of the two-stage flush device for a toilet tank and a tank ball combined together in the present invention.

The first embodiment of the two-stage flush device also has a rotatable button 4, which has a connecting shaft portion 7, straight teeth 10 around the smaller-diameter free end of the connecting shaft portion 7 to engage a teethed hole 13 in one end of a first actuating arm 11, which has a threaded hole 13 in the upper wall defining the teethed hole 12 to tightly secure the first actuating arm 11 with the connecting shaft portion 7. The connect-shaft portion 7 also has a center through hole 22 for a push rod portion 16 of an elongate push rod 5 to fit through, and a rotatable button 35 provided at the outer end of the connecting shaft portion 7, a male thread 38 around the outer end defining a chamber 34. The chamber 34 fits around a push button 36 fixed at the outer end of the elongate push rod 5, and a recovery spring 37 fitted around the push rod portion 16 and contacting the inner end of the push button 36 as shown in FIG. 7. The male thread 38 engages a nut 15 after the elongate push rod 5 is combined with the rotatable button 4, letting the push button 36 of the push rod 5 protrude out of a hole 39 of the nut 15. The elongate push rod 5 can be automatically pushed back to its original position by the recovery spring 37 after the push rod 5 is pushed inward, having its outer end 40 contact with and push an intermediate vertical portion 41 of the second actuating arm 17 so that the second actuating arm 17 is swung with the shaft 24 as a pivot, letting its outer end move up to pull up the chain 30, which then pulls up a valve 29 of a high-level exit tube 28 to flush water into the toilet bowl. The rotatable button 4 can rotate the connecting rod portion 7 together to swing up the first actuating arm 11, which then pulls up a chain 27 connected with a valve 26 of a low-level exit tube 25, and then the chain 27 pulls up the valve 26 to flush more water into the toilet bowl than the elongate push rod does.

Figure 9:
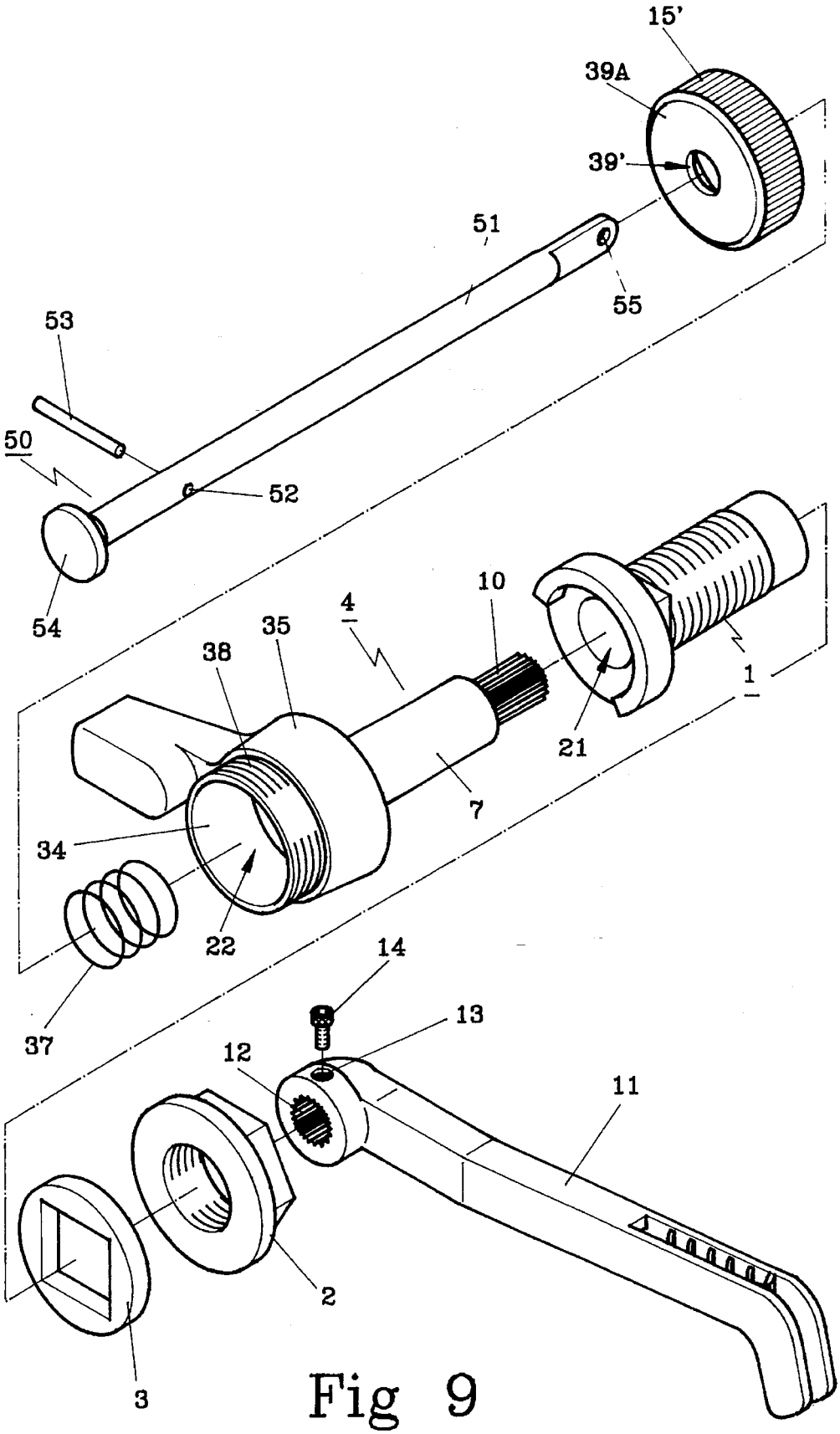
FIG. 9 is an exploded perspective view of a second embodiment of the two-stage flush device for a toilet tank in the present invention.
Figure 10:
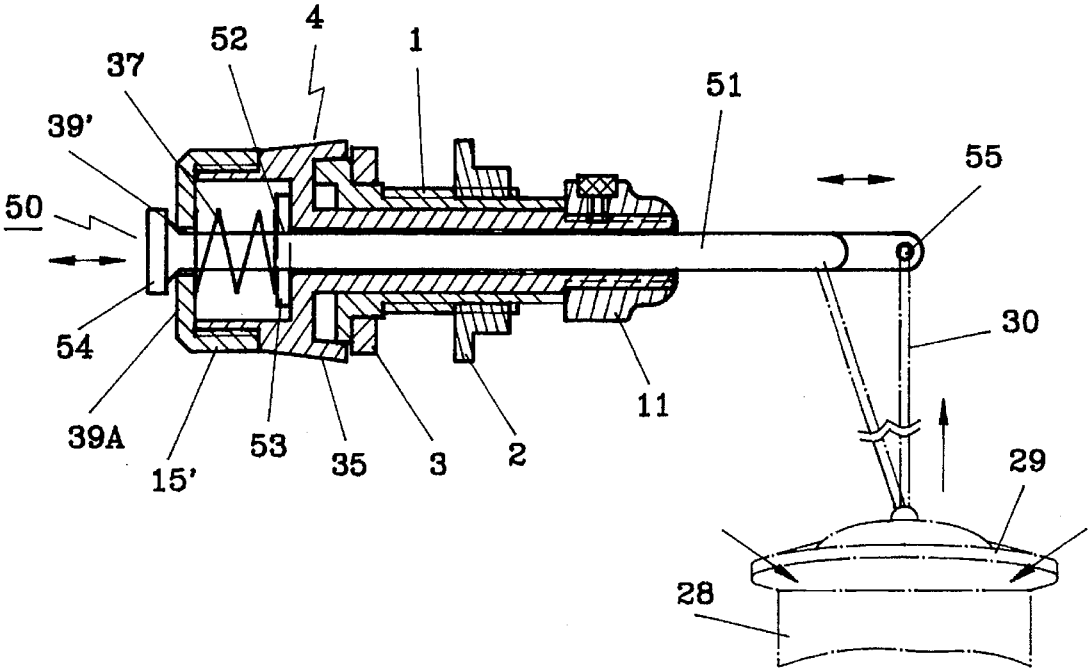
FIG. 10 a cross-sectional view of the second embodiment of the two-stage flush device for a toilet tank in the present invention.
Figure 11:
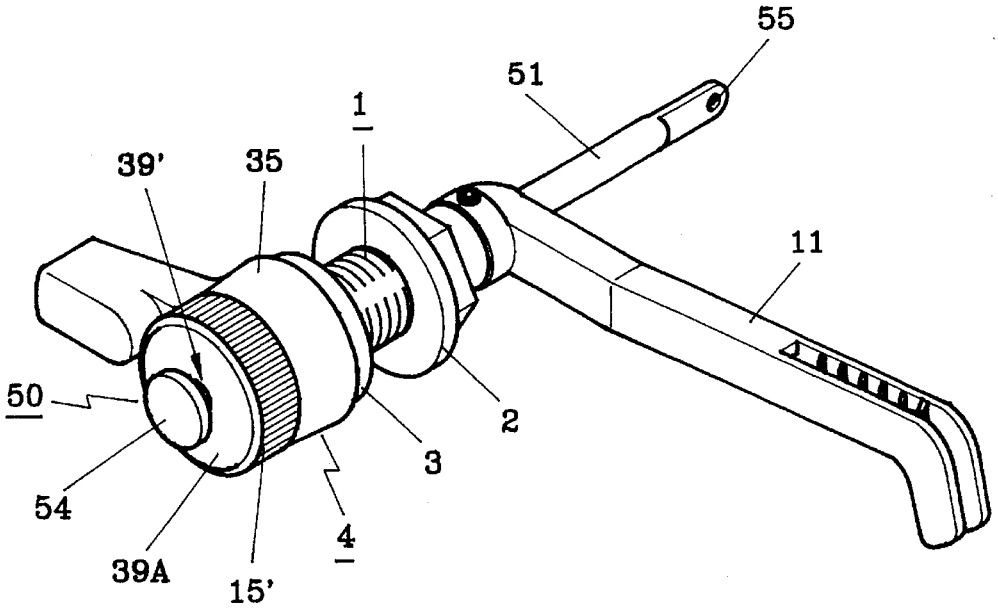
FIG. 11 is a perspective view of the second embodiment of the two-stage flush device for a toilet tank in the present invention.
Figure 12:
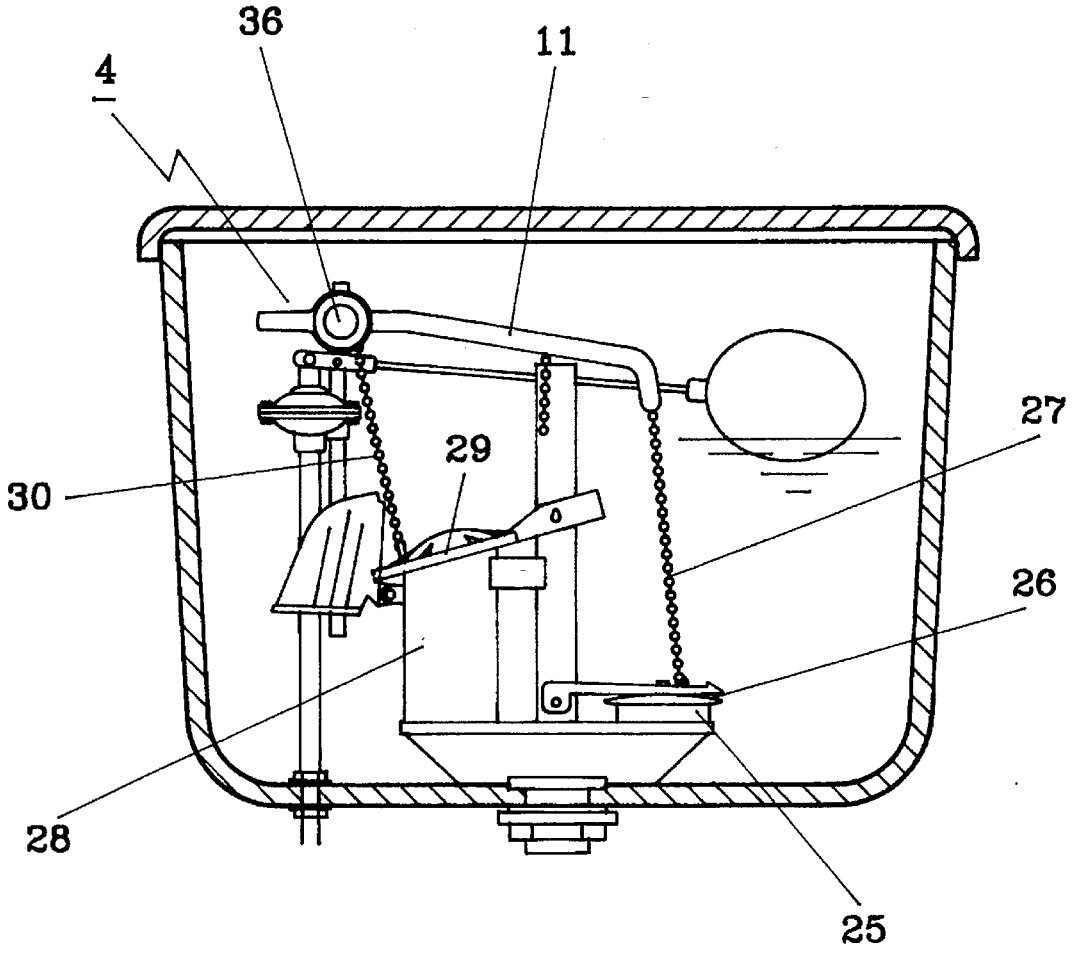
FIG. 12 is a side cross-sectional view of the two-stage flush device installed in a toilet tank in the present invention.

Referring to FIGS. 9–11, a second embodiment of the two-stage flush device in the present invention, comprises the same bolt 1 as that of the first embodiment, a rotatable button 4 of nearly the same structure as that in the first embodiment, but the difference is an elongate pull rod 50, instead of the elongate push rod 5, designed to be pulled outward and the recovery spring 37 deposited in a different way from that of the first one. The nut 15 is the same as the first one, but has a rather small hole 39' and a front surface 39A for the outer end of the spring 37 to elastically push back the front surface 39A. The elongate pull rod 50 has a rod portion 51 extending through the center through hole 22 of the connecting rod portion 7 of the rotatable button 4, and a shaft hole 52 in a front section of the rod portion 51 for a stop shaft 53 to pass through, and a round button 54 at the front end of the rod portion 51. When the button 54 is pulled outward together with the rod portion 51, the valve 29 of the high-level exit tube 28 is pulled by the chain 30 connected with the outer end bored with a hole 55 of the rod portion 51, letting water flow into the toilet bowl. The rotatable button 4 then can be rotated to pull up the valve 26 of the low-level exit tube 25 to let larger volume of water flow into the toilet bowl. Thus this flush is provided with two stages of flushing water of different volume into the toilet bowl.

The second embodiment of the two-stage flush device has two sepa-rate methods for flushing water of different volume, one be pull-ing out the pull rod 50 and the other by rotating the rotatable button 4, preventing accidental wrong handling in flushing water from happening and securing the function of saving water.

What is claimed is:

1. A two stage flush device for a toilet tank comprising:

a cylindrical bolt having a central aperture therethrough and adapted to be fixedly mounted in a hole in a sidewall of said toilet tank, said bolt having an ear at an end thereof;

a nut threadably mated with said bolt for securing said bolt in said hole, and a washer which cooperates with said nut to provide a bearing surface for said bolt against said sidewall;

a rotatable lever having a shaft connected thereto, said shaft extending through said aperture in said bolt, said shaft having a central aperture extending therethrough, said shaft having male threads at one end thereof, and teeth at an opposite end thereof;

an elongate push rod having a button formed on an end thereof, said push rod extending through said aperture in said shaft and terminating in an end which protrudes into said tank;

an annular cap having female threads mating with said male threads on said shaft for retaining said push rod in said shaft;

a first actuating arm having a toothed receiving hole at one end thereof receiving said toothed end of said shaft, a threaded hole extending partially through said one end into said toothed receiving hole, and a set screw received by said threaded hole for tightly securing said actuating arm to said shaft, said arm having an opposite end which is adapted for connection to a low level flush outlet valve; and, a second actuating arm having a pair of ears at one end thereof which are pivotally connected to said ear on said bolt, said second actuating arm having a bent portion abutting said terminal end of said push rod and an opposite end which is adapted for connection to a high-level flush outlet valve; whereby, rotation of said lever rotates said first actuating arm and lifts said opposite end thereof to open said low-level outlet valve, and pushing said button of said elongate push rod pushes said terminal end thereof into said bent portion of said second actuating arm, pivoting said arm and lifting said opposite end thereof to open said high-level flush outlet valve.

2. The two stage flush device as claimed in claim 1, wherein said ears on said second actuating arm have holes therethrough which are aligned with a hole in said ear on said bolt, said second actuating arm being connected to said bolt by a shaft which fits through said holes.

3. The two stage flush device as claimed in claim 1, wherein said nut has a notch therein for allowing said ear on said bolt to pass therethrough.

* * * * *